US010833440B2

(12) United States Patent
Beck

(10) Patent No.: US 10,833,440 B2
(45) Date of Patent: Nov. 10, 2020

(54) ELECTRIC CONTACT WITH ROLLER CONTACT BODIES ON OPPOSING SIDES AND PLUG CONNECTION HAVING SUCH A CONTACT

(71) Applicant: TE Connectivity Germany GmbH, Bensheim (DE)

(72) Inventor: Karl Beck, Langen (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/353,351

(22) Filed: Mar. 14, 2019

(65) Prior Publication Data

US 2019/0214760 A1 Jul. 11, 2019

Related U.S. Application Data

(63) Continuation of application No. PCT/EP2017/073160, filed on Sep. 14, 2017.

(30) Foreign Application Priority Data

Sep. 15, 2016 (DE) ..... 10 2016 217 667

(51) Int. Cl.
*H01R 13/193* (2006.01)
*H01R 13/11* (2006.01)
(Continued)

(52) U.S. Cl.
CPC ..... *H01R 13/193* (2013.01); *H01R 13/113* (2013.01); *H01R 13/2478* (2013.01);
(Continued)

(58) Field of Classification Search
CPC ..... H01R 13/193; H01R 13/113; H01R 13/2478; H01R 39/643
(Continued)

(56) References Cited

U.S. PATENT DOCUMENTS 2,811,700 A * 10/1957 Kuch ..... H01R 12/721 439/59
3,848,223 A 11/1974 Pechard
(Continued)

FOREIGN PATENT DOCUMENTS

DE 4138813 A1 5/1993
DE 102009054825 A1 6/2011
(Continued)

OTHER PUBLICATIONS

Chinese First Office Action and English translation, dated Mar. 2, 2020, 14 pages.
(Continued)

*Primary Examiner* — Alexander Gilman
(74) *Attorney, Agent, or Firm* — Barley Snyder

(57) ABSTRACT

An electric contact for an electrical plug connection includes a receptacle open against a plugging direction and adapted to receive a mating contact in the plugging direction and a plurality of roller contact bodies made of an electrically conductive material and projecting into the receptacle. The roller contact bodies are rotatably held on at least a pair of opposing sides of the receptacle and each form a part of a contact surface adapted to contact the mating contact.

19 Claims, 12 Drawing Sheets

(51) Int. Cl.
*H01R 13/24* (2006.01)
*H01R 39/64* (2006.01)
*H01R 41/00* (2006.01)

(52) U.S. Cl.
CPC ..... *H01R 13/2485* (2013.01); *H01R 39/643* (2013.01); *H01R 41/00* (2013.01)

(58) Field of Classification Search
USPC ..... 439/259
See application file for complete search history.

(56) References Cited

U.S. PATENT DOCUMENTS 3,858,957 A * 1/1975 Harwood ..... H01R 12/82 439/59
4,373,764 A * 2/1983 Ulrich ..... H01R 12/85 29/854
4,629,272 A * 12/1986 Mattingly ..... H01R 13/625 439/318
4,696,531 A * 9/1987 Bohme ..... H01R 13/111 439/851
7,255,586 B2 * 8/2007 Okada ..... H01R 13/20 439/346
8,298,001 B2 * 10/2012 Ashibu ..... H01R 12/88 439/328
8,662,916 B2 * 3/2014 Ashibu ..... H01R 12/88 439/260
2003/0232533 A1 * 12/2003 Burmeister ..... H01R 12/721 439/259
2018/0183179 A1 * 6/2018 Byrd ..... H01R 39/02
2019/0214760 A1 * 7/2019 Beck ..... H01R 13/2485

FOREIGN PATENT DOCUMENTS

EP 2337156 A1 6/2011
FR 2197300 A2 3/1974
JP 52128586 10/1977
JP 52128586 A 10/1977
JP 04014779 1/1992

OTHER PUBLICATIONS

Abstract of EP2337156 related to DE102009054825, dated Jun. 22, 2011, 1 page.
PCT Notification, The International Search Report and the Written Opinion of the International Searching Authority, Intl Appl No. PCT/EP2017/073160, dated Nov. 20, 2017, 17 pages.
Abstract of JP 04014779, dated Jan. 20, 1992, 1 page.
Abstract of EP2337156, dated Jun. 22, 2011, 1 page.
Abstract of DE4138813, dated May 27, 1993, 1 page.

* cited by examiner

ELECTRIC CONTACT WITH ROLLER CONTACT BODIES ON OPPOSING SIDES AND PLUG CONNECTION HAVING SUCH A CONTACT

CROSS-REFERENCE TO RELATED APPLICATIONS

This application is a continuation of PCT International Application No. PCT/EP2017/073160, filed on Sep. 14, 2017, which claims priority under 35 U.S.C. § 119 to German Patent Application No. 102016217667.6, filed on Sep. 15, 2016.

FIELD OF THE INVENTION

The present invention relates to an electric contact and, more particularly, to an electric contact for an electrical plug connection.

BACKGROUND

An electric contact is commonly plugged together with a mating contact in a plugging direction to form an electrical plug connection. The electric contact may have a receptacle receiving a mating contact pin, the receptacle opening against the plugging direction and having a contact surface contacting the mating contact pin. The electric contact, for example, is in the form of a contact sleeve into which a pin- or tab-shaped mating contact pin is inserted.

In the mating of such contacts, one aim is to achieve a stable contact resistance, which requires a high pressing pressure between the contact surfaces in order to break through possible layers of corrosion or foreign matter and establish a direct contact between the electrically conductive materials of the contacts. Such a pressing pressure, however, entails high plugging forces, so that the contacts can only be plugged together with a high expenditure of force. If high currents are to be transferred by way of the contact surfaces, they should lie on one another over as large a surface area as possible, in order to lower the contact resistance. However, with the contact surfaces lying on one another over a large surface area, the frictional resistance during the plugging together increases, so that once again higher plugging forces are necessary.

SUMMARY

An electric contact for an electrical plug connection includes a receptacle open against a plugging direction and adapted to receive a mating contact in the plugging direction and a plurality of roller contact bodies made of an electrically conductive material and projecting into the receptacle. The roller contact bodies are rotatably held on at least a pair of opposing sides of the receptacle and each form a part of a contact surface adapted to contact the mating contact.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
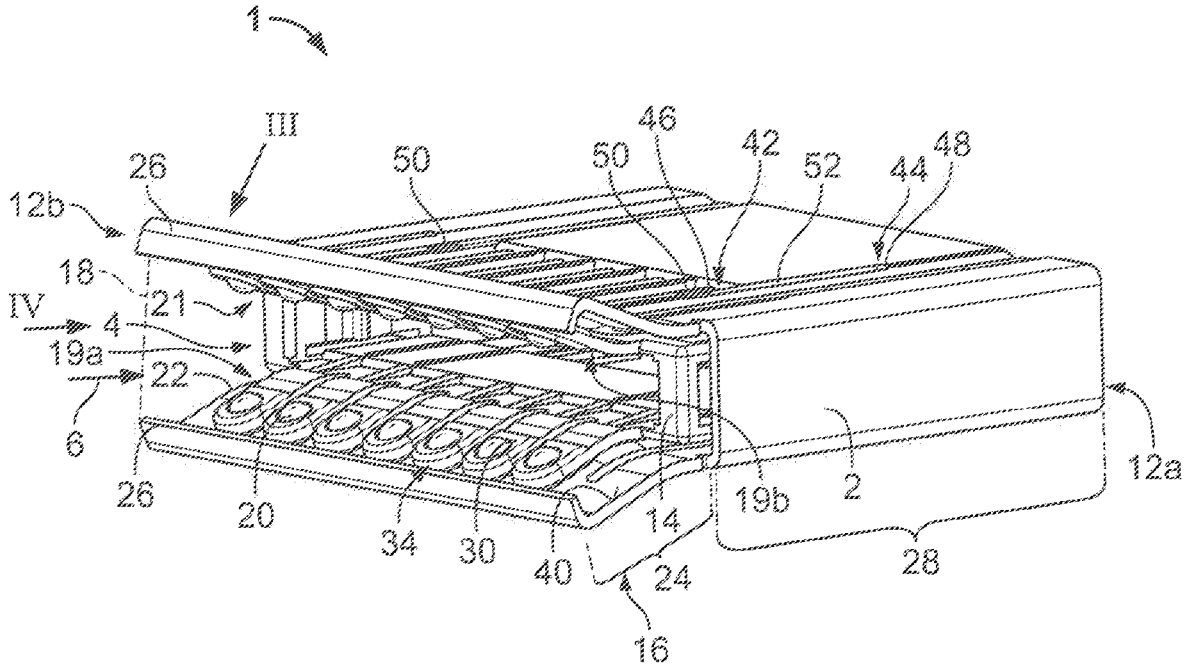
FIG. 1 is a perspective view of an electric contact according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the disclosure to those skilled in the art.

An electric contact 1 according to an embodiment, as shown in FIG. 1, comprises a housing 2 enclosing a receptacle 4. The receptacle 4 opens at least against a plugging direction 6. In the plugging direction 6, a mating contact 8, for example in the form of a contact pin, is inserted into the receptacle 4. In the embodiment shown in FIG. 2, the mating contact 8 is a pin contact. In other embodiments, the mating contact 8 may be a tab. The electric contact 1 and the mating contact 8 mate together to form an electrical plug connection 10.

Figure 2:
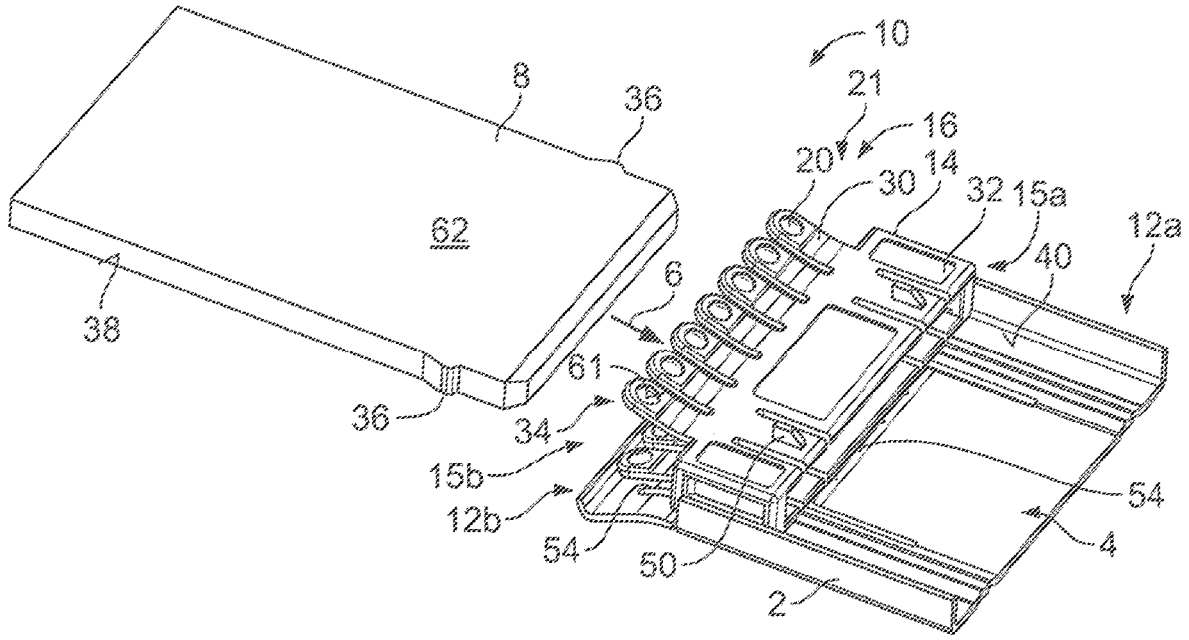
FIG. 2 is a perspective view of the electric contact with a mating contact.

As shown in FIG. 2, in which an upper half of the housing 2 has been omitted, the housing 2 is open at its front end 12*a* in the plugging direction 6 and its rear end 12*b* in the plugging direction 6. In the receptacle 4 there is a slide 14. The slide 14 is designed in a sleeve- or box-shaped manner and lies coaxially in relation to the housing 2. The slide 14 surrounds the receptacle 4. The slide 14 is accommodated in the housing 2 displaceably forward and back along the plugging direction 6 and is open at least at its rear end 15*b* in the plugging direction 6, for inserting the mating contact 8 through. In an embodiment, the slide 14 is also open at the front end 15*a*. An inner cross section of the receptacle 4 transversely in relation to the plugging direction 6 depends on the form of the mating contact 8. The inner cross section may be round, in particular circular, or polygonal, in particular rectangular. In an embodiment, the housing 2 is formed of a conductive material.

In FIGS. 1 and 2, the slide 14 is located in an initial position 16 at an insertion opening 18 at the rear end 12*b* of the housing 2. The rear end 15*b* of the slide 14 lies against the insertion opening 18. A plurality of roller contact bodies 20 are held rotatably on the slide 14, on opposing sides 19*a*, 19*b* of the receptacle 4. The roller contact bodies 20 are inserted in a form-fitting manner into clearances or recesses 22 of the slide 14. The slide 14 consequently forms a roller bearing cage 21. The roller contact bodies 20 project into the receptacle 4. Merely by way of example, the sides 19*a*, 19*b* are the flat sides of the receptacle 4. The roller contact bodies 20 may also be arranged on the narrow sides of the receptacle 4.

The roller contact bodies 20 are produced from a conductive material, and in an embodiment, are produced from a material with a conductivity of at least 30 Siemens/meter (S/m). In an embodiment, the material of the roller contact bodies 20 contains at least one metal from the group of gold, silver, aluminum, and copper. The roller contact bodies 20 may be spheres, cones, truncated cones, barrels, needles and/or cylinders. The slide 14, in an embodiment, is formed from a non-conductive material, for example plastic, and may be injection-molded.

At the insertion opening 18 of the receptacle 4, as shown in FIG. 1, the electric contact 1 has a running-in region 24, which widens against the plugging direction 6. In the shown embodiment, the running-in region 24 is formed by a pair of vanes 26, which project from a sleeve or box-shaped region 28 of the housing 2 against the plugging direction 6 and are inclined with respect to the plugging direction 6.

The slide 14, as shown in FIGS. 1 and 2, has spring tongues or arms 30, which project from a sleeve- or box-shaped portion 32 of the slide 14 against and/or in the plugging direction 6. At least one roller contact body 20 may be provided on each of the spring tongues or arms 30, at or in the vicinity of an end 34 that is facing the insertion opening 18. The spring tongues or arms 30 are preformed such that in a force-free state they tend to move away from one another. The form of the spring tongues or arms 30 follows the widening running-in region 24 when the slide 14 is displaced against the plugging direction 6 towards the rear end 12*b* of the housing 2.

If the slide 14 is displaced from the initial position 16 shown in FIG. 2 at the opening 18 in the plugging direction 6 towards the front end 12*a* of the housing 2, the roller contact bodies 20 move towards one another along the running-in region 24. As soon as the roller contact bodies 20 have arrived in the sleeve- or box-shaped region 28 of the housing 2, the distance between them remains substantially constant during the further movement of the slide 14 in the plugging direction 6. In the region 28, the roller contact bodies 20 have been pressed against the housing 2 as a result of the elastic deformation of the spring tongues or arms 30 that has then occurred, so that they roll on an inner side or surface of the housing 2. The pressing force with which the roller contact bodies 20 are pressed against the housing 2 thereby increases as the distance between the opposing roller contact bodies 20 is increasingly reduced.

The slide 14 is displaceable along the plugging direction 6 between two end positions 42, 44, which are determined by two stops 46, 48, as shown in FIG. 1. The stops 46, 48 may be arranged on the housing 2 and act together with a guiding element 50 on the slide 14. The guiding element 50 may, for example, be a rib 50 protruding into a groove or a slit 52 of the housing 2. The groove 52 extends in a straight line in the plugging direction 6, the stops 46 and 48 are the ends of the groove 52. In another embodiment, this arrangement can also be reversed, so that the groove or the slit 52 is located on the slide 14 and the guiding element 50 is located on the housing 2.

Figure 3:
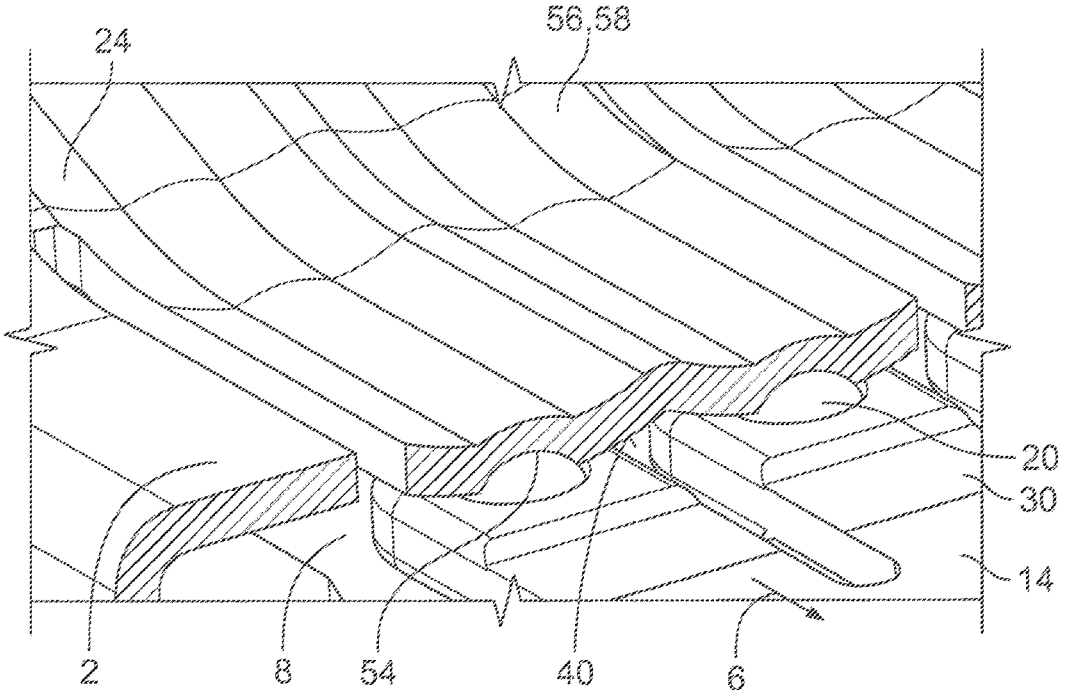
FIG. 3 is a sectional perspective view of the electric contact taken along direction III of FIG. 1.
Figure 4:
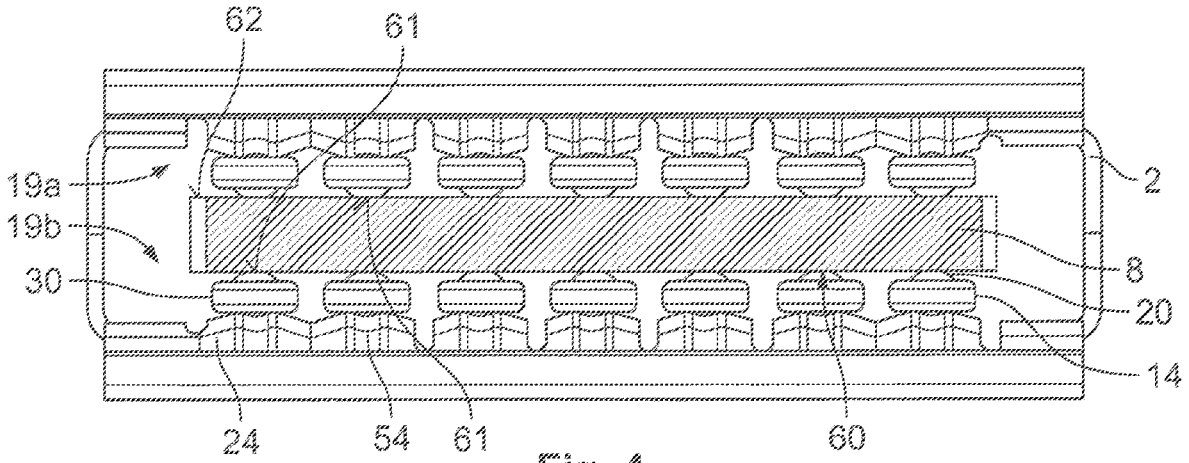
FIG. 4 is a sectional front view of the electric contact taken along direction IV of FIG. 1 with the mating contact inserted.

The housing 2 may also comprise groove-shaped raceways or running grooves 54, as shown in FIGS. 2-4, which extend along the plugging direction 6 and on which the roller contact bodies 20 roll. The running grooves 54 may be formed on housing tongues 56, which slightly yield transversely in relation to the plugging direction 6. The housing tongues 56 may be connected to the housing 2 only at their two ends situated in the plugging direction 6 or only at one end. As a result of their yielding compliance, the housing tongues 56 act as pressing springs 58, which press the roller contact bodies 20 into the receptacle 4 as soon as the housing tongues 56 are deflected. Once the contact pin 8 has been inserted into the receptacle 4 and the slide 14 has moved in the plugging direction 6 out of the rear end position 46 in the plugging direction 6, situated in the direction of the rear end 12*b*, the roller contact bodies 20 come to lie against the contact pin 8. In order to produce sufficiently high contact forces 60, the roller contact bodies 20 are pressed against the running grooves 54, which thereupon yield elastically as shown in FIG. 4. In an embodiment, the pressing springs 58 are made of a plastic in order to create as little friction as possible with the roller contact bodies 20.

The outer surfaces of the roller contact bodies 20 that protrude into the receptacle 4 form a contact surface 61 of the contact 1, as shown in FIG. 4, which contacts the contact surface 62 of the mating contact 8 in the plugged-together state. As shown in FIG. 2, the contact pin 8 has at least one latching element 36, such as a latching projection or a latching recess, which is located on a narrow side 38. As a result of the curved surface of the roller contact bodies 20, the contact forces 60 act on a small surface area and consequently exert a great surface pressure. Even with low contact forces, the pressing pressure is great enough to break through layers of corrosion and foreign matter.

Figure 8:
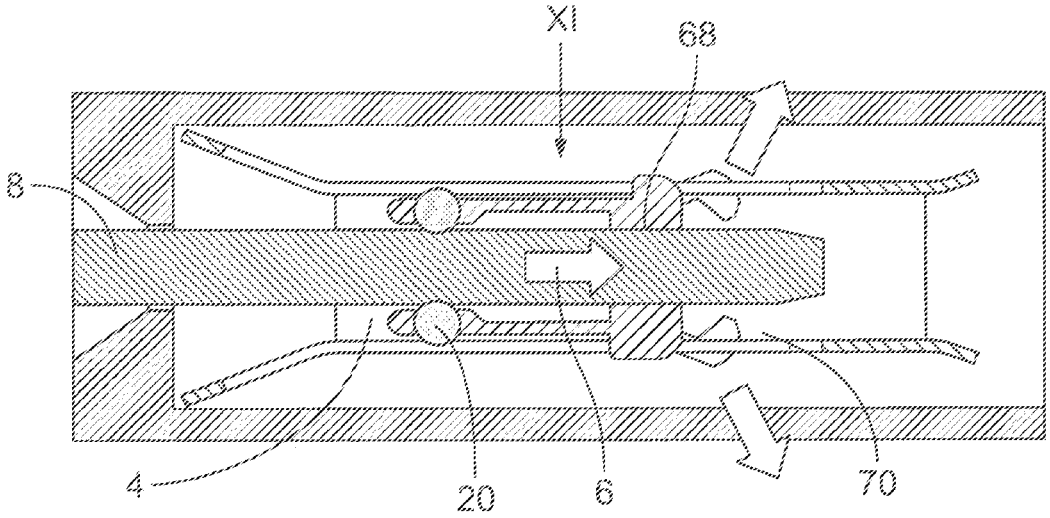
FIG. 8 is a sectional side view of a fourth position of insertion of the mating contact into the electric contact.
Figure 9:
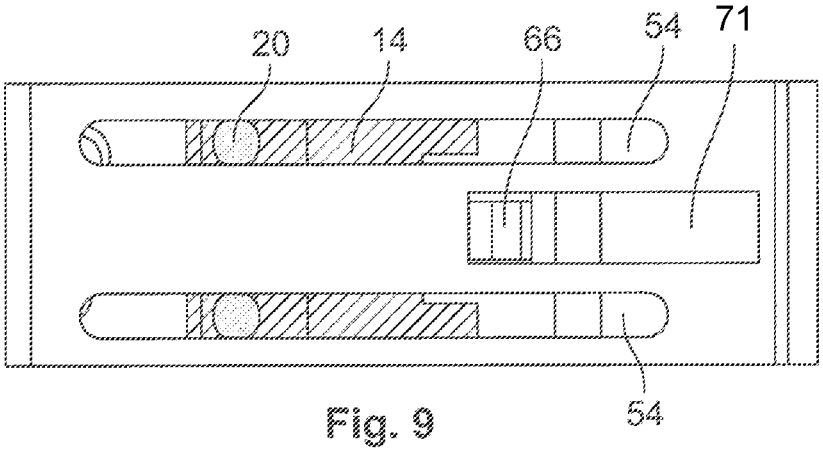
FIG. 9 is a sectional top view of the mating contact in the electric contact taken along direction IX of FIG. 8.

A plugging operation of plugging the mating contact 8 into the electric contact 1 is described in greater detail below with reference to FIGS. 5-9. The running grooves 54 are slit-shaped, as shown in FIG. 9. An elastic yielding compliance of the edges of the running grooves 54 is used for producing the pressing force 60. An outer housing 63 in which the housing 2 is accommodated is shown in FIGS. 5-8.

Figure 5:
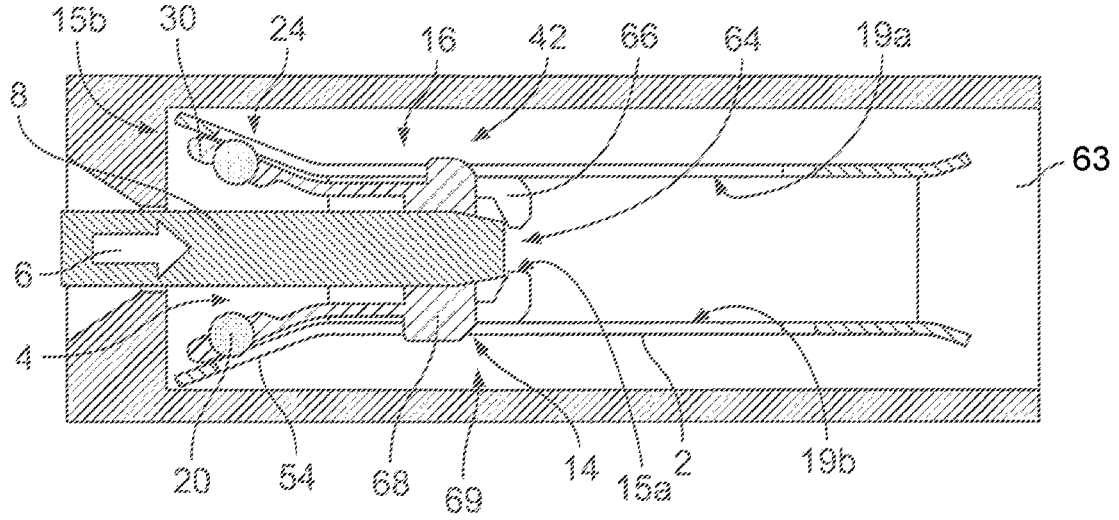
FIG. 5 is a sectional side view of a first position of insertion of the mating contact into the electric contact.

In FIG. 5, the slide 14 is in the initial position 16, as it is shown in FIGS. 1 and 2, that is to say at the rear end position 42. The roller contact bodies 20 lie in the running-in region 24 and are at a distance from one another that is greater than the thickness of the material of the contact pin 8 in the same direction. In the initial position, the roller contact bodies 20 do not touch the contact pin 8.

In FIG. 5, the contact pin 8 has just been fully inserted into the slide 14, so that at its end 64 situated in the plugging direction 6 it bears against at least one driver 66 of the slide 14. The embodiment of FIG. 5 shows two drivers 66 on the opposing sides 19*a*, 19*b*. Each driver 66 protrudes into the receptacle 4 and is located at the front end 15*a* of the slide 14. The slide 14 has a plurality of bearing supports 68, which receive and center the contact pin 8 in an exactly fitting manner on at least two opposing sides transversely in relation to the plugging direction 6.

When the contact pin 8 is then pushed further in the plugging direction 6, it moves the slide 14 from the initial position 16 in the plugging direction 6 by way of the drivers 66. The roller contact bodies 20 thereby roll on the housing 2, in particular in the running grooves 54. The roller contact bodies 20 are rotatable about at least one axis of rotation oriented transversely in relation to the plugging direction 6. Further directions of movement of the rolling surface with a correspondingly differently oriented axis of rotation in the region of the contact surface 62 may make compensating movements between the two contacts 1, 8 possible, for example in an environment that is subjected to vibrational loading. Thus, for example, the axes of rotation may be aligned along the plugging direction 6, in order to allow relative movements between the contacts 1, 8 transversely in relation to the plugging direction 6. The roller contact bodies 20 may be mounted rotatably about a number of axes of rotation simultaneously. Thus, spherical roller contact bodies 20 may be held rotatably in each direction.

Figure 6:
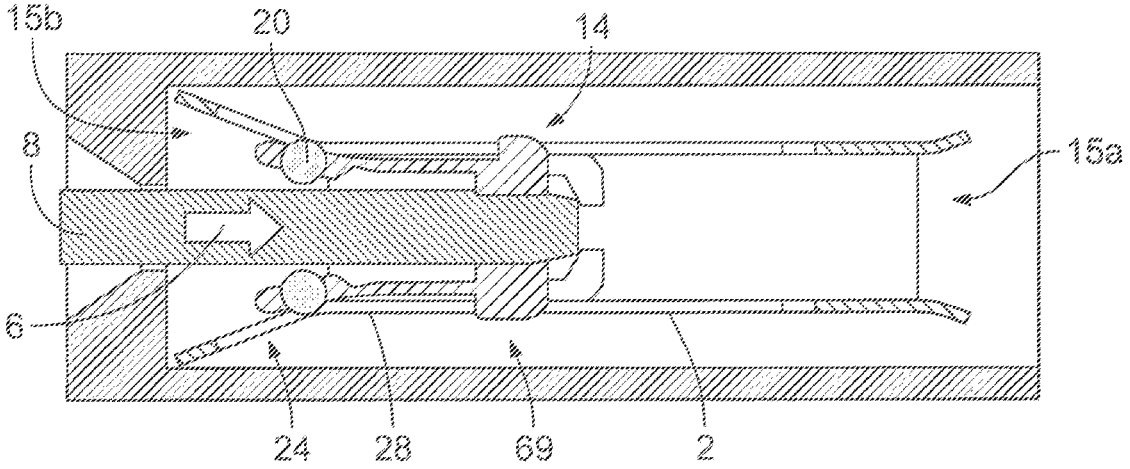
FIG. 6 is a sectional side view of a second position of insertion of the mating contact into the electric contact.

The roller contact bodies 20 on the spring tongues or arms 30 thereby run towards one another along the running-in region 24 without touching the contact pin 8. Such a position 69 of the slide 14, referred to hereinafter as the driving position 69, is shown in FIG. 6. In the driving position 69, the slide 14 has been moved out of the initial position in the plugging direction 6 and the roller contact bodies 20 are located at the end of the running-in region 24 that is situated in the direction of insertion 6, at the transition to the region 28 of the housing 2. The slide 14 and the contact pin 8 move at the same speed.

Figure 7:
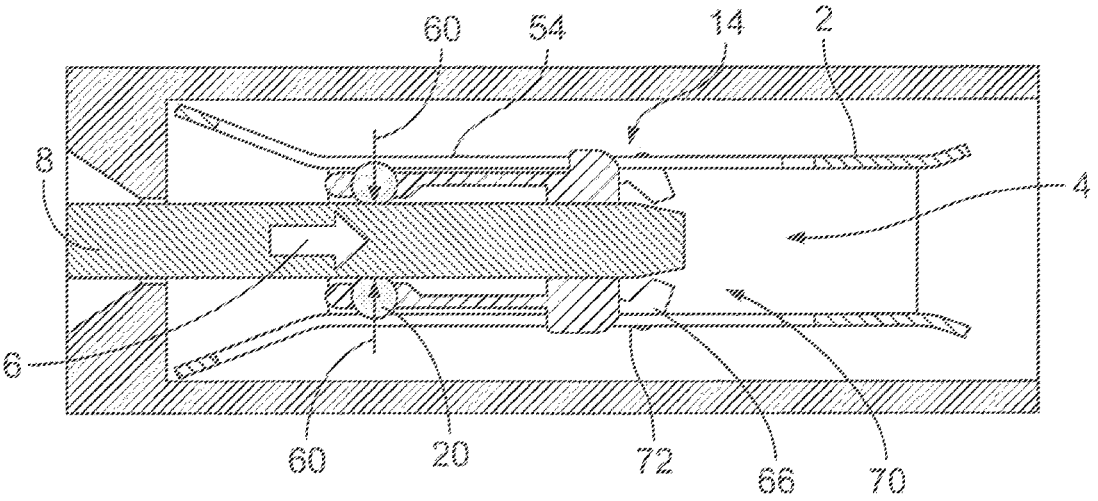
FIG. 7 is a sectional side view of a third position of insertion of the mating contact into the electric contact.

A release position 70 of the slide 14, shown in FIG. 7, lies between the end positions 42, 44 of the slide 14 and in particular before the driving position 69 in the plugging direction 6, closer to the front end 12*a* of the housing 2. The roller contact bodies 20 lie on the contact surface 62 of the contact pin 8 under the effect of the contact force 60. At the same time, the roller contact bodies 20 have been pressed into the running grooves 54, which have been elastically deflected transversely in relation to the plugging direction 6 and produce the pressing force 60. The roller contact bodies 20 then roll on the housing 2 and on the contact pin 8. The slide 14 is then no longer moved in the plugging direction 6 directly by the contact pin 8, but by the movement of the rolling roller contact bodies 20. This speed of movement of the slide 14 is lower than the speed at which the contact pin 8 is inserted into the receptacle 4. The contact pin 8 consequently overtakes the slide 14. The driver 66 has been moved out of the receptacle 4, as shown in FIG. 8, so that the contact pin 8 can move past the driver 66. The movement of the driver 66 out of the receptacle 4 is made possible for example by a groove- or slit-shaped recess 71, as shown in FIG. 9, which is entered by the driver 66 from when the release position 70 of the slide 14 is reached. For this purpose, the driver 66 may be arranged on a spring tongue 72.

The position in which the drivers 66 have been moved out of the receptacle 4, as shown in FIG. 8, corresponds in this case to the position from which the roller contact bodies 20 roll both on the contact pin 8 and on the housing 2. In this way it is ensured that the slide 14 moves continuously into the release position 70 and further into the end position 44. Starting from the release position 70 shown in FIG. 7, the contact pin 8 can then be moved further in the plugging direction 6. It is thereby centered and held by the roller contact bodies 20 and the bearing supports 68, as shown in FIGS. 7 and 8. As a result of the rolling movement, the removal of material from the contact surface 62 of the mating contact 8 is small, so that even after a very high number of plugging cycles the electric contact 1 has only a very low amount of wear.

The movement of the slide 14 may be divided into two portions, the first portion extending away from the initial position 16 of the slide 14 situated towards the insertion opening 18 of the receptacle 4 and the second portion extending up to the end position 42 remote from the insertion opening 18. In the first portion, the slide 14 moves at the same speed as the mating contact 8 and is moved exclusively by the mating contact 8. This first portion is made up in particular of the driving positions 69. In the second portion, the slide 14 moves more slowly than the mating contact 8 and is moved exclusively by the roller contact bodies 20. The roller contact bodies 20 only roll on either the housing 2 or the mating contact 8 in the first portion, rolling both on the mating contact 8 and on the housing 2 in the second region. This measure allows the travel of the slide 14 during the insertion of the mating contact 8 to be reduced, so that a compact form of construction is achieved, which can in particular also maintain standard dimensions of existing contacts and contact pins. The second portion is made up of the release positions 70.

Various phases of the plugging together of an electric contact 1 according to another embodiment and the contact pin 8 are shown in FIGS. 10-15. For the sake of brevity, only the differences from the embodiment described with respect to FIGS. 1-9 are described in detail herein.

In the embodiment of FIGS. 10-15, the driver 66 is part of a latching arrangement 74, which also includes the latching element 36 on the contact pin 8. In the shown embodiment, the driver 66 is arranged opposite the narrow side 38 of the contact pin 8. In another embodiment, the driver 66 may be arranged opposite the flat side 76 of the contact pin 8, that is to say on one of the sides 19*a* and 19*b*. The latching arrangement 74 may in particular be used in addition to the design that is shown in FIGS. 5 to 9.

Figure 10:
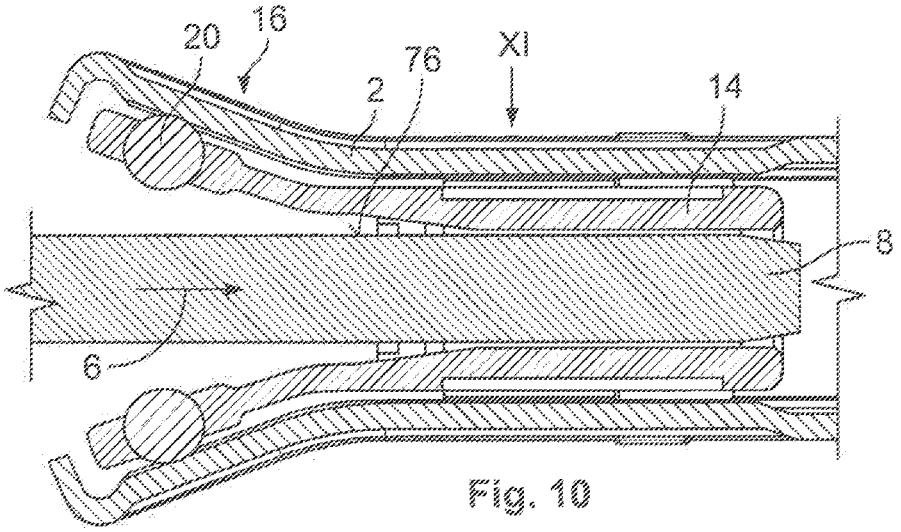
FIG. 10 is a sectional side view of an electric contact according to another embodiment with a mating contact in a first position.
Figure 11:
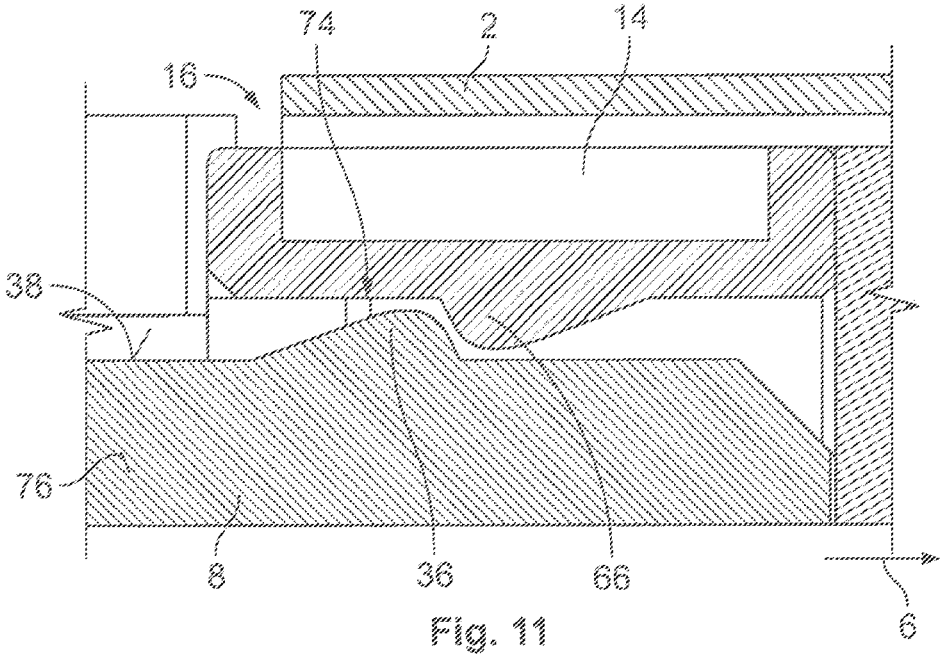
FIG. 11 is a sectional top view of the mating contact in the electric contact taken along direction XI of FIG. 10.

The latching arrangement 74 engages in the initial position 16 of the slide 14, so that the slide 14 is moved in the plugging direction 6 by the contact pin 8 as a result of the form fit in the plugging direction 6 that is established by the latching arrangement 74. The initial position 16 is shown in FIGS. 10 and 11.

The driver 66 and the latching element 36, designed here as a projection, lie against one another, so that the movement of the contact pin 8 is transferred to the slide 14. The roller contact bodies 20 are kept at a distance from the contact pin 8. Instead of the two projections 36, 66 lying against one another, as in FIGS. 11 and 13, in another embodiment the slide 14 or contact pin 8 may also be just one projection which engages in a corresponding recess on the other element.

Figure 12:
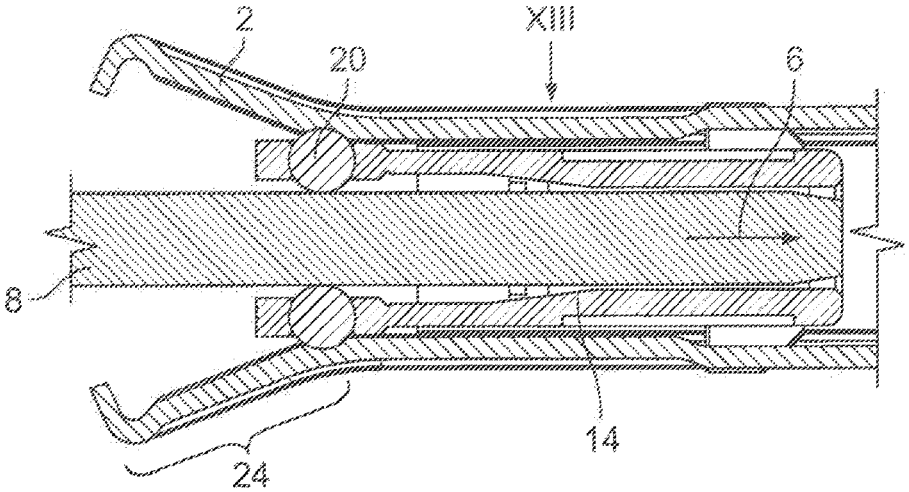
FIG. 12 is a sectional side view of the electric contact with the mating contact in a further position.
Figure 13:
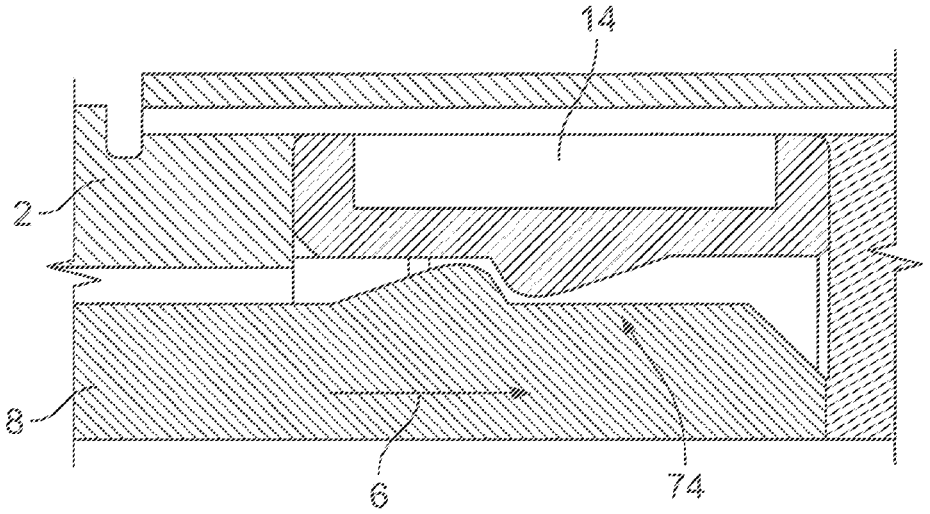
FIG. 13 is a sectional top view of the mating contact in the electric contact taken along direction XIII of FIG. 12.

In the course of the movement in the plugging direction 6, the roller bodies 20 come to lie both against the contact pin 8 and against the housing 2, as shown in FIG. 12. This is the case whenever the roller contact bodies 20 have reached the end of the running-in region 24 situated in the plugging direction 6. At this position, the contact pin 8 begins to overtake the slide 14, since the speed of the slide 14 is then determined by the translational speed of the roller contact bodies 20 in the plugging direction 6. This translational speed is lower than the speed of the slide 14 in the plugging direction.

Figure 14:
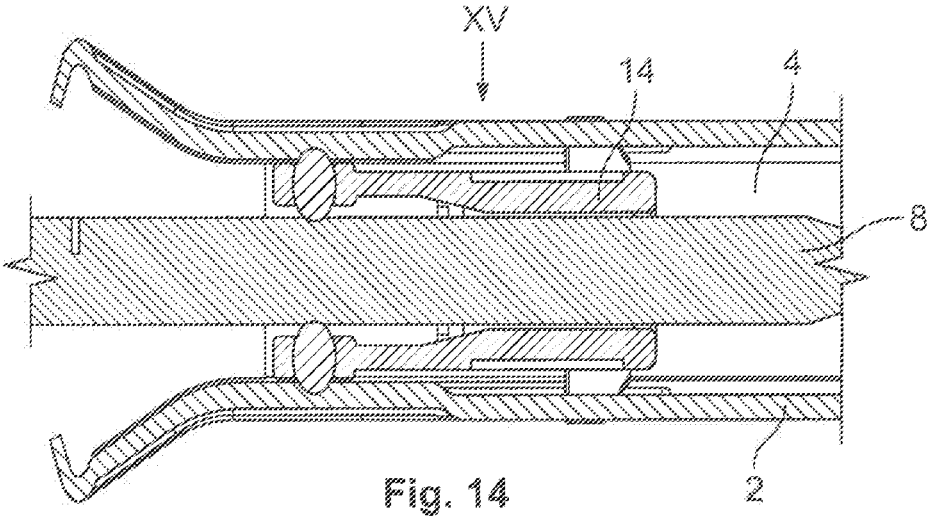
FIG. 14 is a sectional side view of the electric contact with the mating contact in a further position.
Figure 15:
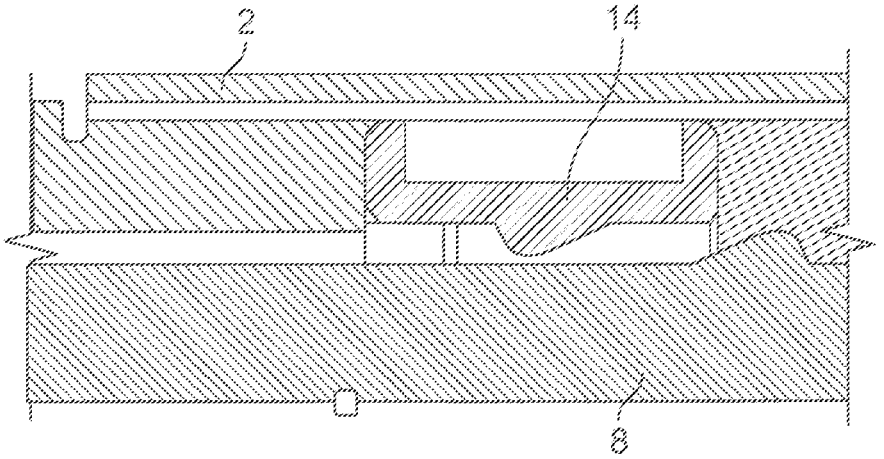
FIG. 15 is a sectional top view of the mating contact in the electric contact taken along direction XV of FIG. 14.

As shown in FIGS. 14 and 15, as a result of the higher speed of the contact pin 8, the latching arrangement 74 latches of its own accord, and in an embodiment, before or in the end position 44 of the slide 14. The latching arrangement 74 secures the contact pin 8 in the receptacle 4. A play between the pin contact 8 and the slide 14 in the plugging direction 6 that is made possible by the latching arrangement 74 may be used to compensate relative movements between the plug 1 and the contact pin 8, in particular in environments that are subjected to vibrational loading.

Figure 16:
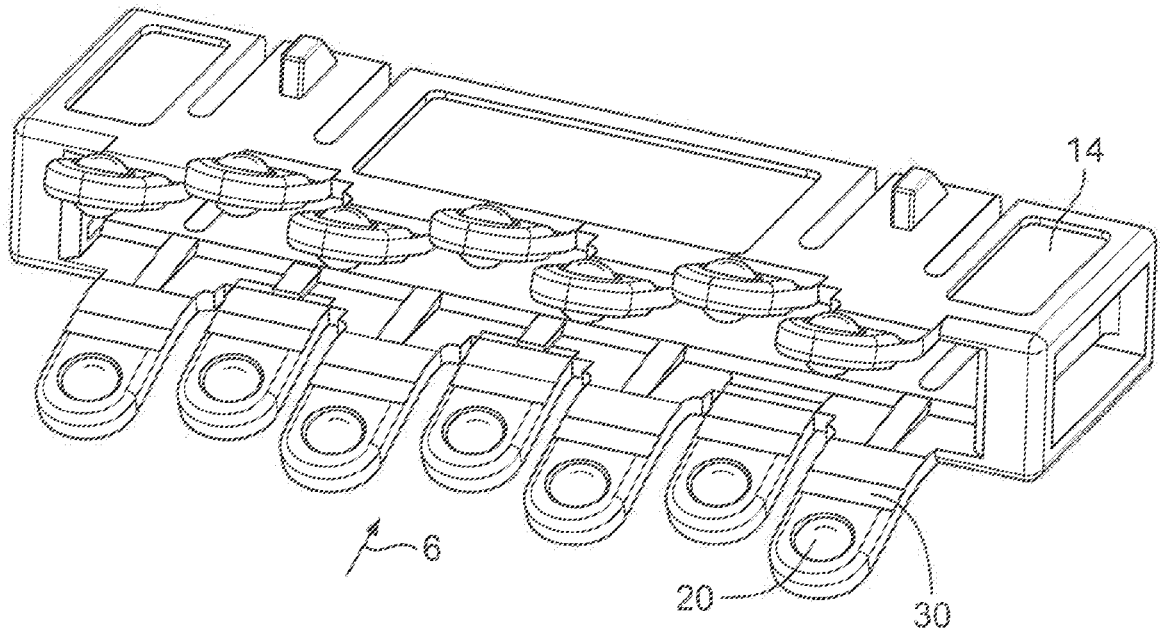
FIG. 16 is a perspective view of a slide of an electric contact according to an embodiment.

In an embodiment shown in FIG. 16, the slide 14 has an individual row of roller contact bodies 20 extending transversely in relation to the plugging direction 6. In another embodiment, more than one row of roller contact bodies 20 and/or roller contact bodies arranged offset in relation to one another can also be used. As shown in FIG. 16, the spring tongues or arms 30 at the end of which the roller contact bodies 20 are held are of different lengths. The roller contact bodies 20 consequently lie on the contact pin 8 at a distance from one another in the plugging direction 6, which leads to better supporting of tilting moments that act on the contact pin 8.

Figure 17:
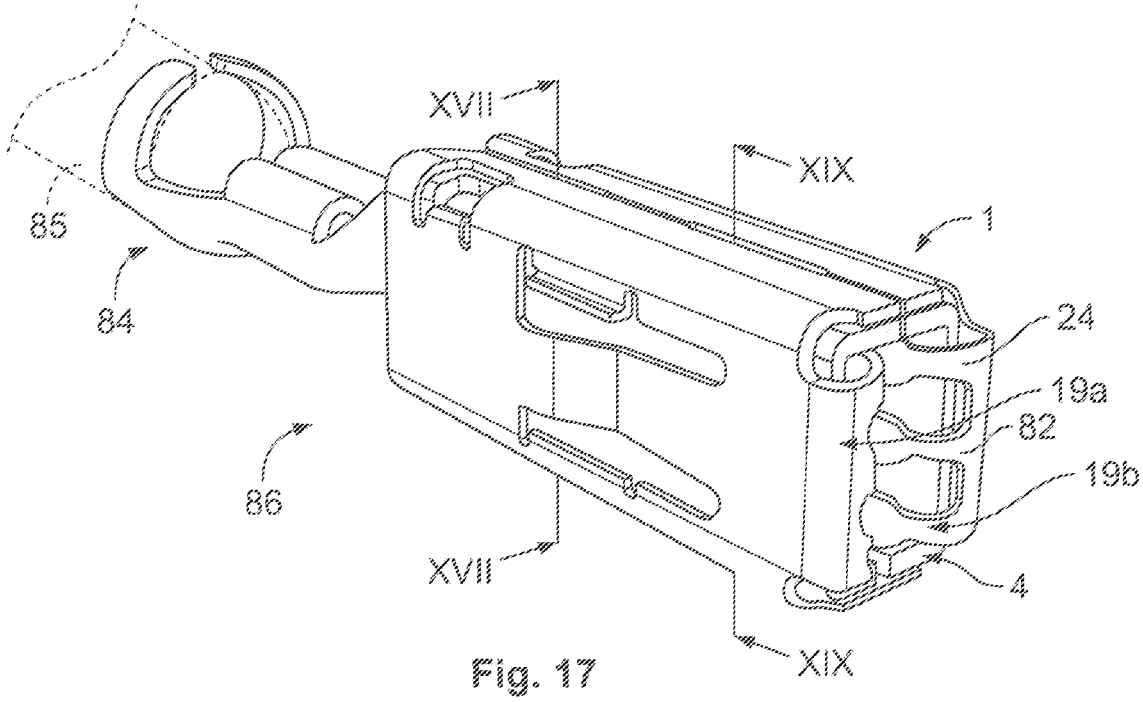
FIG. 17 is a perspective view of an electric contact according to another embodiment.
Figure 18:
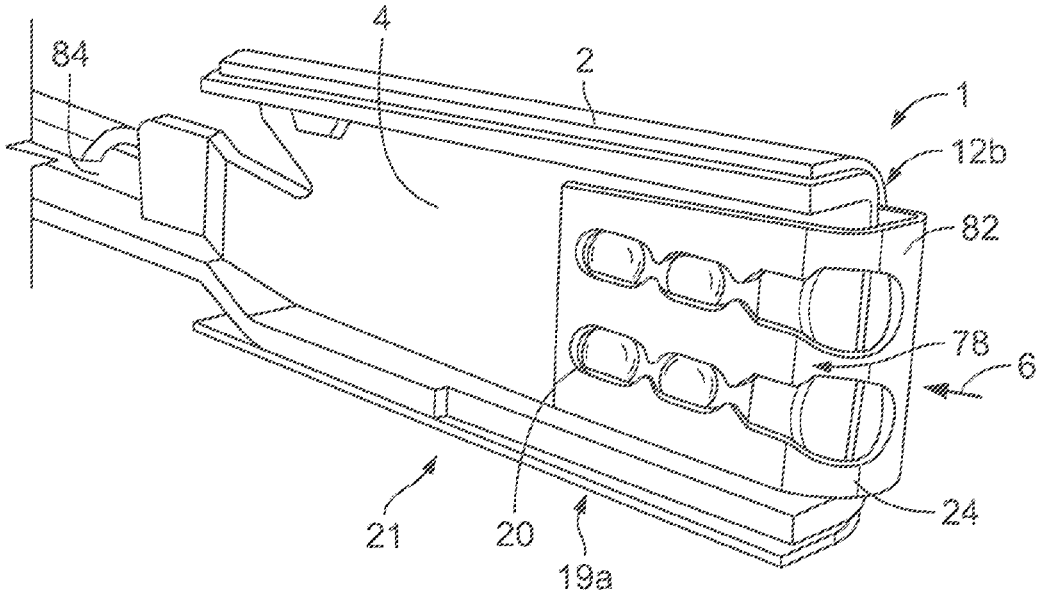
FIG. 18 is a sectional perspective view of the electric contact taken along line XVIII-XVIII of FIG. 17.
Figure 19:
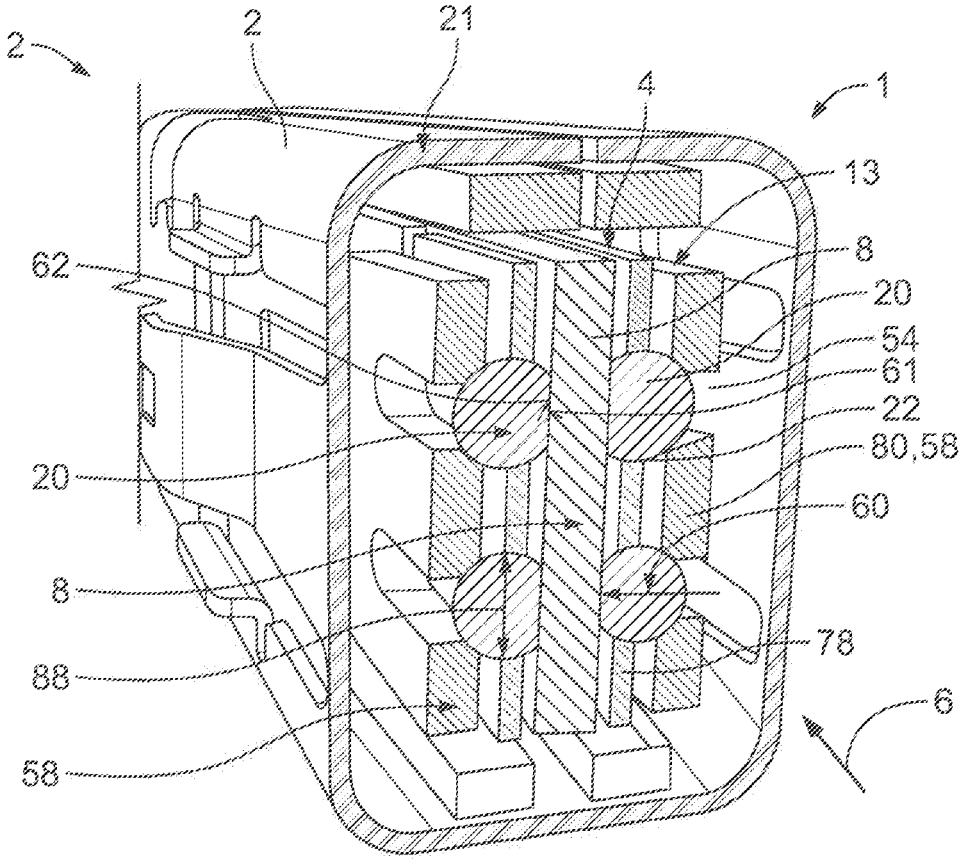
FIG. 19 is a sectional perspective view of the electric contact taken along line XIX-XIX of FIG. 17.

As shown in another embodiment in FIGS. 17-19, the electric contact 1 does not have to have the movable slide 14.

The electric contact 1 of FIGS. 17-19 has rotationally mounted roller contact bodies 20, which lie opposite one another with respect to the receptacle 4 on the sides 19*a*, 19*b*. The housing 2 surrounds a roller bearing cage 21, which may be formed as one part or, as shown, as two parts. An inner part 78 of the roller bearing cage 21 faces the receptacle 4. An outer part 80 of the roller bearing cage 21 is arranged between the housing 2 and the inner part 78. The roller contact bodies 20 are arranged between the inner part 78 and the outer part 80. The outer part 80 serves as a pressing spring 58. In the same way as the running grooves 54 of the previous embodiments, the pressing spring 58 is elastically deflectable transversely in relation to the plugging direction 6, so that the contact force 60 is produced when the roller contact bodies 20 are pressed by the inserted contact pin 8 out of the receptacle 4 against the action of the pressing spring 58.

Figure 20:
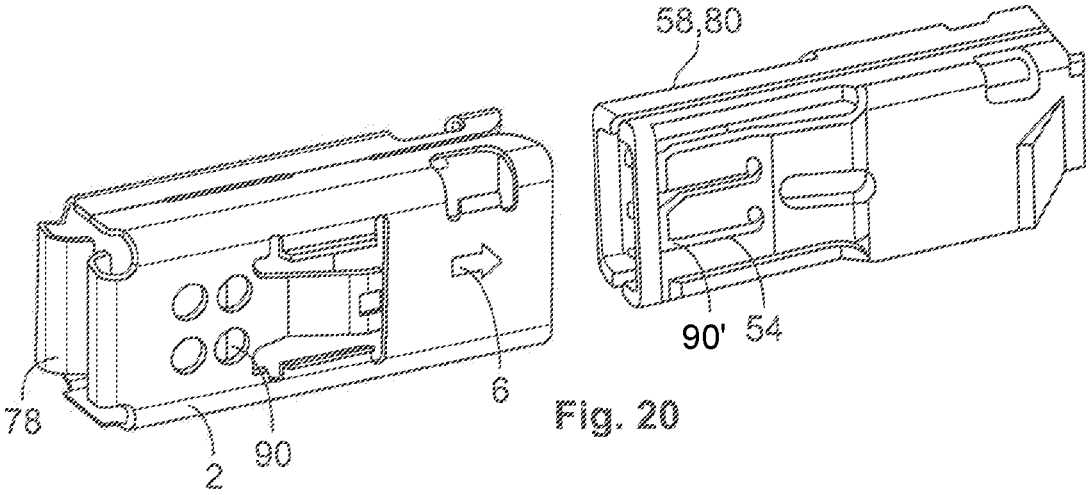
FIG. 20 is an exploded perspective view of an inner part and an outer part of a roller bearing cage.

The inner part 78 may be connected to the housing 2 in a material-bonding manner, in particular monolithically, by way of a bent and/or folded connecting portion 82, as shown in FIGS. 18 and 20. The connecting portion 82 may form a sloping running-in region 24 that widens against the plugging direction 6.

A fastening portion 84 of the electric contact 1, as shown in FIG. 17, fastens a conductor 85 or fastens the electric contact 1 in a plugging contact. In the shown embodiment, the electric contact 1 is a crimping contact 86, in which the fastening portion 84 forms a crimping portion for crimping the conductor 85. The fastening portion 84 may be formed with the housing 2 in a material-bonding manner, in particular monolithically, and/or, as shown, with the outer part 80.

The roller contact bodies 20 are held in a form-fitting and rotatable manner between the inner part 78 and the outer part 80, as shown in FIGS. 18 and 19. The greatest cross section 88 of each of the roller contact bodies 20 lies between the inner part 78 and the outer part 80. The roller contact bodies 20 rest in receptacles 90 in the inner part 78 and outer part 80, which are in line with one another transversely in relation to the plugging direction 6. During the insertion of the contact pin 8 in the plugging direction 6, the roller contact bodies 20 roll on its contact surface 62 and thus reduce the plugging forces necessary for the plugging. The roller contact bodies 20 thereby remain translationally stationary, held by the roller bearing cage 21, and only rotate in the receptacles 90.

An assembly of the contact 1 of FIGS. 17-19 will now be described in greater detail with reference to FIGS. 20-27.

In a first step, shown in FIG. 20, the housing 2 is pushed over the inner part 78 in the plugging direction 6. The housing 2 has insertion openings 90', the number and position of which corresponds to the number and position of the receptacles 90 of the inner part 78. On the inner part 78 there are a number of insertion openings 90' that is less than the number of receptacles 90 or the number of roller contact bodies 20. For all of the roller contact bodies 20 to be arranged between the pressing spring 58 and the inner part 78, for assembly purposes the pressing spring 58 is displaceable in the housing 2 along the plugging direction 6 like a slide 14. In various displacing positions, different insertion openings 90 in the housing 2 are in line with the insertion openings 90' in the pressing spring 58, so that the roller contact bodies 20 can be inserted through the housing 2 and the pressing spring 58 into the recesses 22 of the inner part 78. Subsequently, the pressing spring 58 is once again displaced along the plugging direction 6, in order to insert roller contact bodies 20 into other receptacles 22, which are then in line with the insertion openings 90' and the pressing spring 58. The already assembled roller contact bodies 20 thereby roll in the longitudinal grooves 54, which adjoin the insertion opening 90' of the pressing spring 58.

Figure 21:
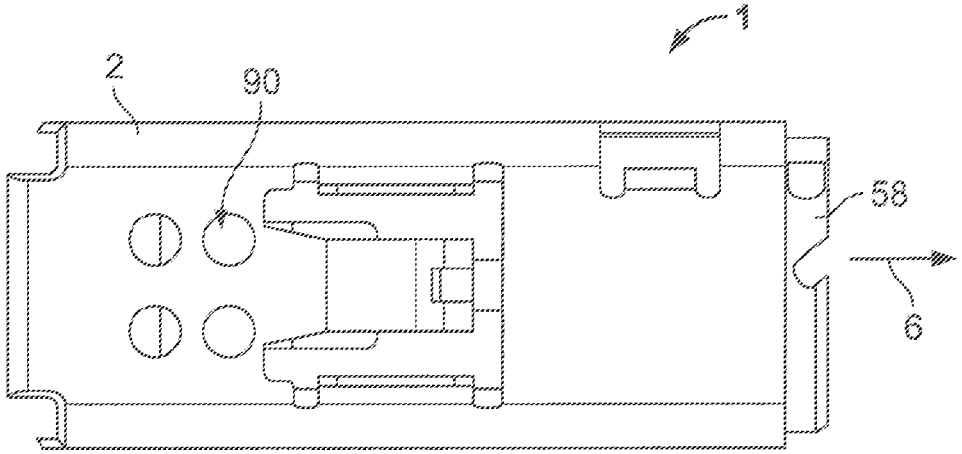
FIG. 21 is a side view of the inner part inserted in the outer part.
Figure 22:
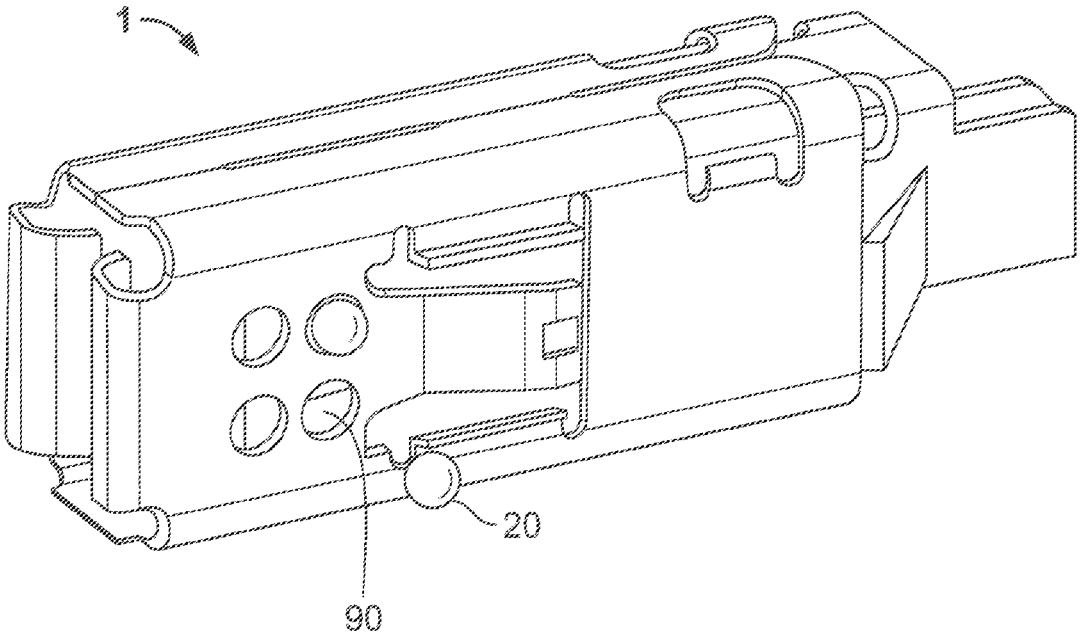
FIG. 22 is a perspective view of the electric contact with a roller contact body.
Figure 23:
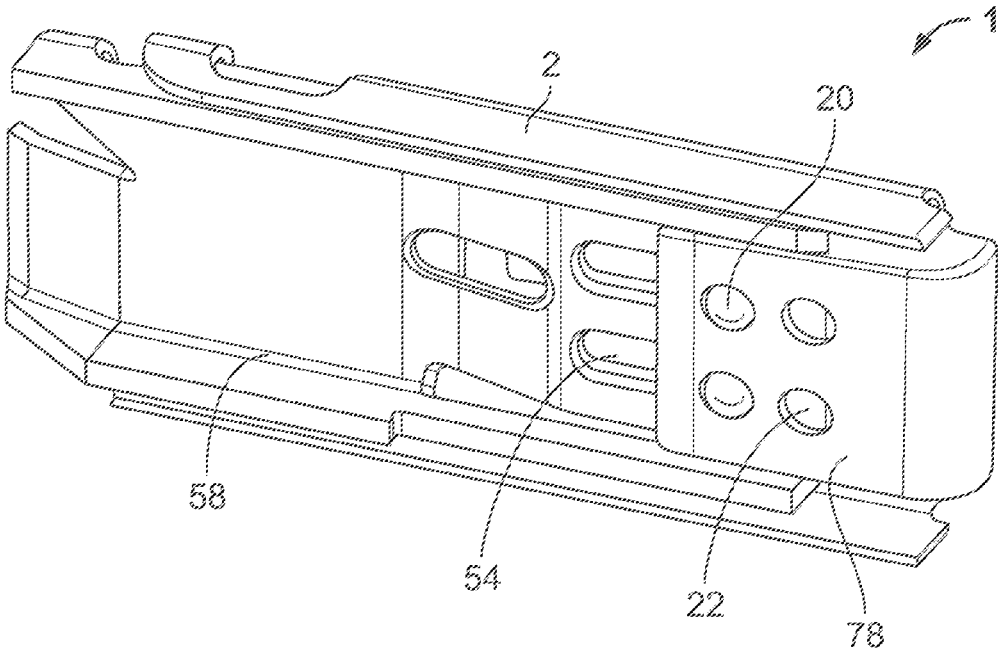
FIG. 23 is a sectional perspective view of the electric contact with the roller contact body inserted in an insertion opening.

In FIG. 21, the housing 2 has been pushed in the plugging direction 6 over the pressing spring 58, so that the insertion openings 90' and receptacles 90 are in line with one another. As shown in FIG. 22, the roller contact bodies 20 are then inserted through the insertion openings 90', until they are accommodated in the recesses 22 in line with the running grooves 54, as shown in FIG. 23.

Figure 24:
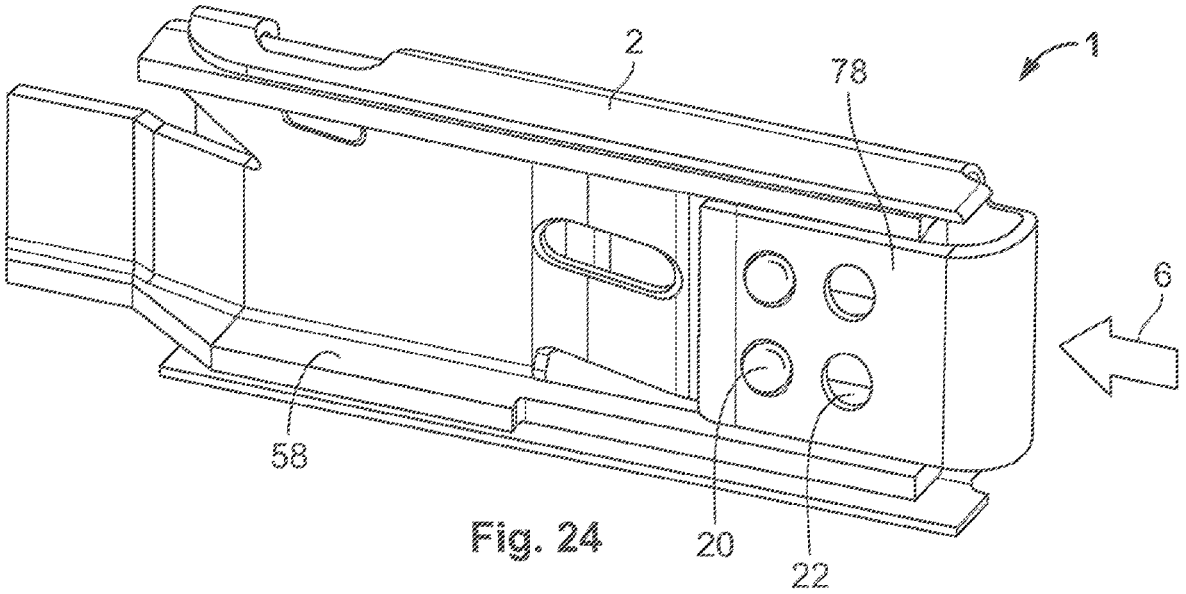
FIG. 24 is a sectional perspective view of the electric contact with the inner part moved with respect to the outer part along a plugging direction.

In order to load the still free receptacles 22 with roller contact bodies 20, the pressing spring 58 and the housing 2 are once again moved in relation to one another along the plugging direction 6, until still free recesses 22 of the inner part 78 are in line with the insertion openings 90' in the pressing spring 58 and in the housing 2, as shown in FIG. 24. As a result of the displacement of the pressing spring 58 in the housing 2, the already inserted roller contact bodies 20 are then held between the pressing spring 58 and the inner part 78 since they are supported on the running groove 54. The running groove 54 has for this purpose a clear width that is smaller than the diameter of the roller contact bodies 20.

Figure 25:
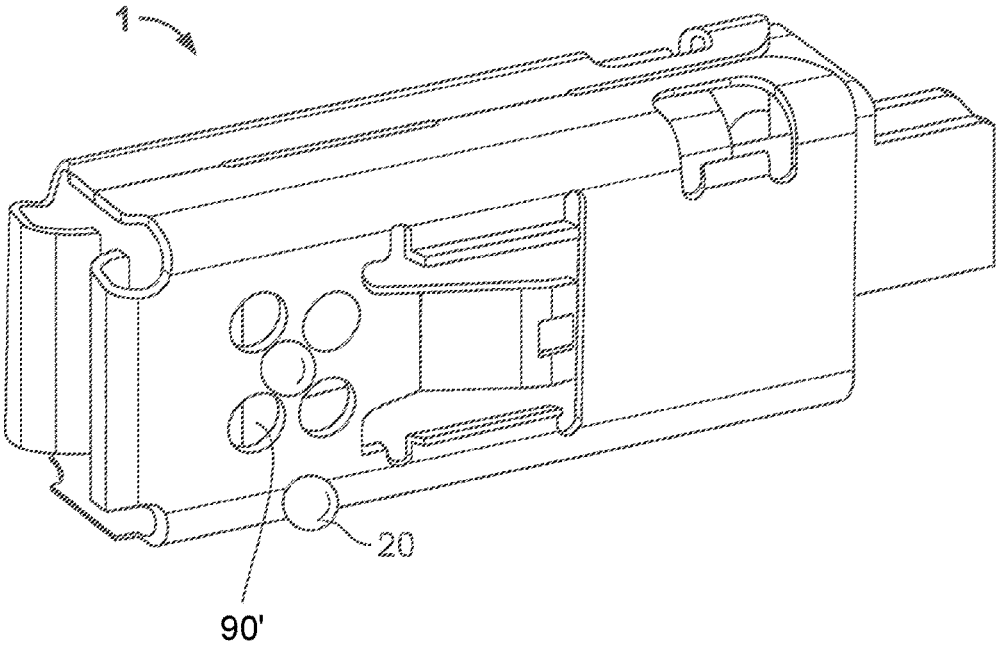
FIG. 25 is a perspective view of the electric contact with a plurality of roller contact bodies.
Figure 26:
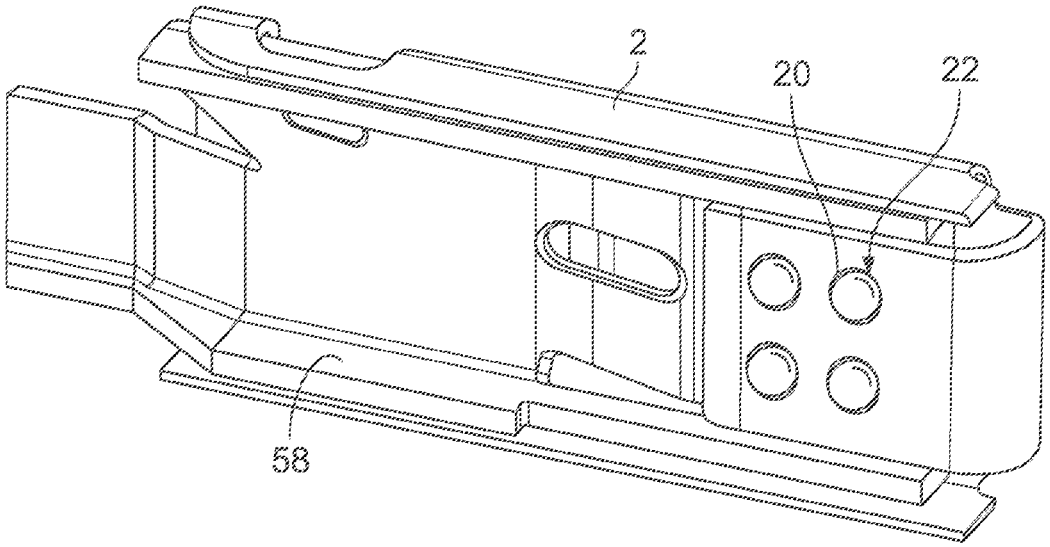
FIG. 26 is a sectional perspective view of the electric contact with the roller contact bodies inserted into insertion openings.
Figure 27:
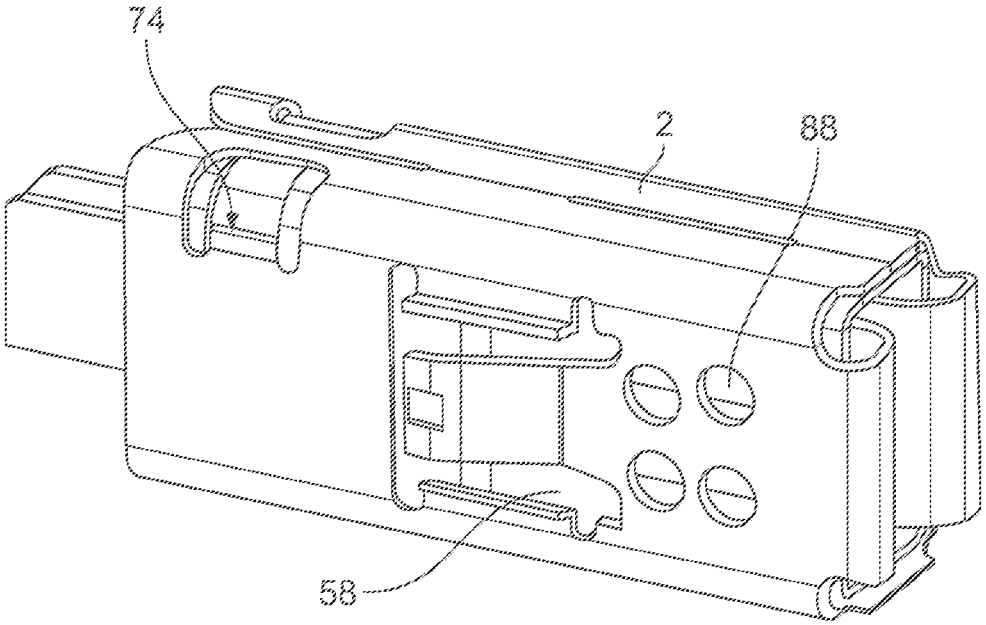
FIG. 27 is a perspective view of the electric contact with the roller contact bodies fully assembled.

When the insertion openings 90' are in line with the still free recesses 22 at the new displacing position, as shown in FIGS. 25 and 26, the roller contact bodies 20 are once again inserted through the insertion openings 90'. Thus, all of the recesses 22 can be loaded with roller contact bodies 20 one after the other. Subsequently, the pressing spring 58 can be arrested in the housing 2 by a latching arrangement 74 in a displacing position in which the insertion openings 90' of the housing 2 are no longer in line with the insertion openings 90 of the pressing spring 58, as shown in FIG. 27, and all of the roller contact bodies 20 lie in the running grooves 54 of the pressing spring 58.

What is claimed is:

1. An electric contact for an electrical plug connection, comprising:

a receptacle open against a plugging direction and adapted to receive a mating contact in the plugging direction;

a plurality of roller contact bodies made of an electrically conductive material and projecting into the receptacle, the roller contact bodies are rotatably held on at least a pair of opposing sides of the receptacle and each form a part of a contact surface adapted to contact the mating contact; and a slide movable along the plugging direction, wherein the slide is movable between an initial position and a release position, and portions of the slide holding the roller contact bodies on the opposing sides are kept at a distance further from one another in the initial position than in the release position.

2. The electric contact of claim 1, wherein the slide has a driver projecting into the receptacle and adapted to engage the mating contact.

3. The electric contact of claim 2, wherein, in the release position of the slide, the driver is moved out of the receptacle.

4. An electrical plug connection, comprising:

a sleeve-shaped electric contact having a first contact surface;

a pin-shaped mating contact complementary to the electric contact and having a second contact surface, the electric contact is adapted to receive the mating contact in a plugging direction and the first contact surface is adapted to contact the second contact surface, at least one of the first contact surface and the second contact surface is formed by a plurality of rotatable roller contact bodies each made of an electrically conductive material;

a slide movable along the plugging direction, the slide having a driver projecting into a receptacle of the electric contact and adapted to engage the mating contact, wherein in a release position of the slide, the driver is moved out of the receptacle of the electric contact.

5. The electrical plug connection of claim 4, wherein the roller contact bodies are held on the slide.

6. The electrical plug connection of claim 5, wherein the pin-shaped mating contact is inserted into the slide.

7. The electrical plug connection of claim 6, wherein, in a driving position of the slide, the roller contact bodies lie at a non-zero distance from the pin-shaped contact in a direction normal to the plugging direction when the pin-shaped contact is received within the mating contact.

8. The electrical plug connection of claim 7, wherein, in the release position of the slide located at a distance from the driving position in the plugging direction, the roller contact bodies abut the pin-shaped contact and the housing in a rolling manner.

9. The electrical plug connection of claim 4, further comprising a housing, a portion of the slide is disposed in the housing such that the roller contact bodies roll on the housing during a portion of a movement of the slide.

10. An electric contact for an electrical plug connection, comprising:

a receptacle open against a plugging direction and adapted to receive a mating contact in the plugging direction;

a plurality of roller contact bodies made of an electrically conductive material and projecting into the receptacle, the roller contact bodies are rotatably held on at least a pair of opposing sides of the receptacle and each form a part of a contact surface adapted to contact the mating contact;

a slide movable along the plugging direction; and a housing, a portion of the slide is disposed in the housing such that the roller contact bodies roll on the housing during a portion of a movement of the slide.

11. The electric contact of claim 10, wherein the slide is movable between an initial position and a release position, the roller contact bodies on the opposing sides are kept at a distance further from one another in the initial position than in the release position.

12. The electric contact of claim 10, wherein the housing is monolithically formed with a fastening portion adapted to attach to a conductor or an outer housing.

13. The electric contact of claim 10, wherein the roller contact bodies are rotatable but translationally stationary with respect to a roller bearing cage disposed in the housing.

14. The electric contact of claim 13, wherein the housing defines a pressing spring acting on at least one of the roller contact bodies.

15. The electric contact of claim 14, wherein the roller contact bodies are held deflectably between the housing and the pressing spring in a direction transverse to the plugging direction.

16. The electric contact of claim 14, wherein the roller bearing cage has an inner part and an outer part, the roller contact bodies are held between the inner part and the outer part.

17. The electric contact of claim 16, wherein the inner part and the outer part are connected to one another in a material bonding manner by a bent and/or folded connecting portion.

18. The electric contact of claim 17, wherein the outer part serves as the pressing spring.

19. The electric contact of claim 18, wherein the outer part has an insertion opening through which one of the roller contact bodies is adapted to fit.

* * * * *